US010697714B2

(12) United States Patent
Koyama et al.

(10) Patent No.: US 10,697,714 B2
(45) Date of Patent: Jun. 30, 2020

(54) MULTIPLE TUBE-TYPE HEAT EXCHANGER AND HEAT TRANSFER TUBE CLEANING METHOD FOR SAME

(71) Applicant: MITSUBISHI HITACHI POWER SYSTEMS, LTD., Yokohama-shi, Kanagawa (JP)

(72) Inventors: Yoshinori Koyama, Tokyo (JP); Masato Murayama, Yokohama (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 55 days.

(21) Appl. No.: 16/069,051

(22) PCT Filed: Aug. 24, 2016

(86) PCT No.: PCT/JP2016/074593
§ 371 (c)(1),
(2) Date: Jul. 10, 2018

(87) PCT Pub. No.: WO2017/126148
PCT Pub. Date: Jul. 27, 2017

(65) Prior Publication Data

US 2019/0017756 A1 Jan. 17, 2019

(30) Foreign Application Priority Data

Jan. 22, 2016 (JP) ..... 2016-011059

(51) Int. Cl.
*F28D 7/00* (2006.01)
*F28F 9/22* (2006.01)
(Continued)

(52) U.S. Cl.
CPC ..... *F28F 9/0219* (2013.01); *F23J 1/00* (2013.01); *F28D 7/06* (2013.01); *F28G 1/16* (2013.01);
(Continued)

(58) Field of Classification Search
CPC ..... B23P 19/024; F28D 7/1646; F28D 7/06; F28D 7/16; F28D 7/1607; F28F 1/325;
(Continued)

(56) References Cited

U.S. PATENT DOCUMENTS 3,703,905 A * 11/1972 Ice, Jr. ..... F28G 1/12 134/144
4,049,048 A * 9/1977 Leedham ..... F28F 1/325 165/159
(Continued)

FOREIGN PATENT DOCUMENTS

JP S46033018 Y1 11/1971
JP S52-012201 Y1 3/1977
(Continued)

OTHER PUBLICATIONS

International Search Report dated Nov. 15, 2016, issued in counterpart application No. PCT/JP2016/074593, with English translation. (5 pages).
(Continued)

*Primary Examiner* — Davis D Hwu
(74) *Attorney, Agent, or Firm* — Westerman, Hattori, Daniels & Adrian, LLP

(57) ABSTRACT

A multiple tube-type heat exchanger (25) is provided with a cylindrical heat exchanger shell (36) and a heat transfer tube unit (38) which is mounted in a removable manner within the heat exchanger shell (36). The heat transfer tube unit (38) is provided with a plurality of heat transfer tubes (50) extending inside the heat exchanger shell (36) in the longitudinal axis direction; a binding member (51 serves also as this binding member) for binding the heat transfer tubes (50); and a plurality of rotary journal sections (51, 52) which are concentric with the center axis (CL) of the heat transfer tube unit (38), are provided at positions located at a distance from each other in the direction of the center axis (CL), and
(Continued)

enable the heat transfer tube unit (38) to be supported by predetermined rotation support sections provided outside the heat exchanger shell (36).

3 Claims, 9 Drawing Sheets

(51) Int. Cl.

| | |
|---|---|
| ***F28F 9/02*** | (2006.01) |
| ***F28G 1/16*** | (2006.01) |
| ***F23J 1/00*** | (2006.01) |
| ***F28D 7/06*** | (2006.01) |
| ***F28G 15/00*** | (2006.01) |
| *F28D 7/16* | (2006.01) |
| *F28F 9/013* | (2006.01) |

(52) U.S. Cl.
CPC ..... *F28G 1/166* (2013.01); *F28G 15/00* (2013.01); *F28D 7/16* (2013.01); *F28D 7/1607* (2013.01); *F28F 9/0131* (2013.01); *F28F 2009/226* (2013.01); *F28F 2280/02* (2013.01); *F28F 2280/06* (2013.01)

(58) Field of Classification Search
CPC .. F28F 9/0219; F28F 9/0131; F28F 2009/226; F28F 2280/02; F28F 2280/06; F23J 1/00; F28G 1/16; F28G 15/00; F28G 1/12
USPC ..... 165/159
See application file for complete search history.

(56) References Cited

U.S. PATENT DOCUMENTS

| | | | | |
|---|---|---|---|---|
| 4,548,260 | A * | 10/1985 | Stachura | F28D 7/1646 165/160 |
| 2016/0033210 | A1* | 2/2016 | Reich | B23P 19/024 165/67 |

FOREIGN PATENT DOCUMENTS

| | | | |
|---|---|---|---|
| JP | S52-120446 | A | 10/1977 |
| JP | S58-33478 | B2 | 7/1983 |
| JP | S61-256198 | A | 11/1986 |
| JP | 2010-190459 | A | 9/2010 |

OTHER PUBLICATIONS

Written Opinion dated Nov. 15, 2016, issued in counterpart application No. PCT/JP2016/074593, with English translation. (19 pages).

* cited by examiner

MULTIPLE TUBE-TYPE HEAT EXCHANGER AND HEAT TRANSFER TUBE CLEANING METHOD FOR SAME

TECHNICAL FIELD

The present invention relates to a multiple tube-type heat exchanger and a heat transfer tube cleaning method for the same.

BACKGROUND ART

A multiple tube-type heat exchanger is also called a shell and tube type, and is, for example, a heat exchanger having a configuration where a heat transfer tube unit, in which multiple heat transfer tubes (tubes) are bound in a bundle, is accommodated inside a heat exchanger shell (shell) which is horizontally mounted. A process liquid to be cooled or heated and a temperature control solution for adjusting the temperature of the process liquid flow in such a multiple tube-type heat exchanger.

There is a case where a process liquid flows in a shell chamber inside the heat exchanger shell and a case where the process liquid flows in the heat transfer tubes. For example, the process liquid generally flows in the shell chamber in a case where the process liquid is a suspension including a large amount of hard particulate solids such as crushed slag and abrasive grains. That is because there are concerns about the inside of the heat transfer tubes wearing out due to abrasive properties of the suspension when the suspension passes through the heat-transfer tubes as the shapes of flow passages inside the heat transfer tubes are simpler than inside the shell chamber, and thus a flow rate tends to be higher in the heat transfer tubes.

Since the suspension flowing in the shell chamber comes into contact with the surfaces of the heat transfer tubes in such a manner, suspended matters gradually adhere to and deposit on the surfaces of the heat transfer tubes, thereby becoming a sticky scale. As the sticky scale covers the surfaces of the heat transfer tubes, a heat transferring performance decreases. For this reason, it is necessary to periodically clean the surfaces of the heat transfer tubes to remove the sticky scale. In the case of cleaning the heat transfer tubes, a water chamber-forming lid (end plate), which is one end of the heat exchanger shell, is removed to pull out the heat transfer tube unit inside the heat exchanger shell in an axis direction. The outer surfaces of the multiple heat transfer tubes are cleaned by a brush, high-pressure water injection, and chemical spraying.

In a multiple tube-type heat exchanger and a cleaning method for the same disclosed in PTL 1, the multiple tube-type heat exchanger adopts a structure of being rotatable about a central axis in advance, a shell chamber is filled with a certain amount of abrasive solid particles such as sand and metal balls, and the entire multiple tube-type heat exchanger is rotated under such conditions. Consequently, the sticky scale which is adhered to and is deposited on the surface of each heat transfer tube is removed due to the abrasive action of the abrasive solid particles.

CITATION LIST

Patent Literature

[PTL I] Japanese Unexamined Patent Application Publication No. 58-33478

SUMMARY OF INVENTION

Technical Problem

In a method of pulling the heat transfer tube unit out from the heat exchanger shell and cleaning the heat transfer tube unit, it is difficult to clean the surfaces of the heat transfer tubes positioned in a diameter direction middle portion (depths) of the heat transfer tube unit since the structure in which the heat transfer tube unit binds the multiple heat transfer tubes in a bundle is adopted as described above. Consequently, the sticky scale cannot be effectively removed.

Since the heat transfer tube unit is large and heavy, the position of the heat transfer tube unit cannot be easily changed even when the heat transfer tube unit is cleaned in a state of being put on a temporary cleaning stand. For example, in a case where high-pressure water is injected to an upper portion of the heat transfer tube unit, preliminary operation such as temporarily providing a dedicated scaffold and lifting to change the position by means of a crane is necessary. This is a significant cause for decreasing cleaning efficiency.

Since a structure in which the heat exchanger shell is rotatable is required to be adopted in the cleaning method of PTL 1, there is no choice but to connect piping of the process liquid and the temperature control solution, which is connected to the heat exchanger shell, to an end surface of the heat exchanger shell such that the piping and the end surface are coaxial. For this reason, restriction of pipe layout increases. There is also a disadvantage that a seal structure for sealing between the piping and the heat exchanger shell by connecting the piping and the heat exchanger shell together so as to be relatively rotatable becomes complicated.

As described above, since it is difficult to remove the sticky scale on the heat transfer tube unit, area where a heat transferring performance is effectively demonstrated decreases to approximately 20 to 30% of the entire surface area of the heat transfer tubes, and thus it has been impossible to operate with high energy efficiency.

The invention is devised to solve the problems described above, and an object thereof is to provide a multiple tube-type heat exchanger that has a simple structure enabling heat transfer tubes accommodated inside a heat exchanger shell to be efficiently cleaned and enabling the heat exchanger to operate with high energy efficiency, and a heat transfer tube cleaning method for the same.

Solution to Problem

To solve the problems, the invention adopts the following means.

According to a first aspect of the invention, there is provided a multiple tube-type heat exchanger including a cylindrical heat exchanger shell and a heat transfer tube unit that is mounted in a removable manner inside the heat exchanger shell. The heat transfer tube unit includes a plurality of heat transfer tubes extending inside the heat exchanger shell in a longitudinal axis direction, a binding member that binds the heat transfer tubes, and a plurality of rotary journal sections that are concentric with a central axis of the heat transfer tube unit, are provided at positions located at a distance from each other in a direction of the central axis, and enable the heat transfer tube unit to be supported by a predetermined rotation support section provided outside the heat exchanger shell.

In the multiple tube-type heat exchanger having the configuration, when cleaning the heat transfer tube unit, the heat transfer tube unit is taken out from the heat exchanger shell, and the plurality of respective rotary journal sections are supported by the predetermined rotation support section provided outside the heat exchanger, shell. Therefore, in a state where the heat transfer tube unit is placed on the rotation support section, the heat transfer tube unit can freely rotate about the central axis.

For this reason, the heat transfer tube unit can toe effectively cleaned to a diameter direction middle portion (surfaces of the heat transfer tubes positioned at deep depths) of the heat transfer tube unit by using, for example, a high-pressure water injector while the heat transfer tube unit is being rotated.

At this time, since high-pressure water can be injected from a mounting surface (ground level) of the rotation support section without temporarily providing a scaffold, preliminary operation such as temporarily providing a scaffold is not necessary.

Therefore, the heat transfer tubes can be efficiently cleaned, thereby enabling the multiple tube-type heat exchanger to be operated with high energy efficiency.

Since the cleaning of the heat transfer tube unit requires removing only the heat transfer tube unit from the heat exchanger shell with the heat exchanger shell configuring the multiple tube-type heat exchanger being fixed on the spot, it is hot necessary to remove piping of the process liquid and a temperature control solution, which is connected to the heat exchanger shell. Consequently, the multiple tube-type heat exchanger can be kept simple.

In the multiple tube-type heat exchanger having the configuration, a configuration where at least one of the rotary journal sections also serves as the binding member, allows the plurality of heat transfer tubes to penetrate therethrough and to be fixed thereto, and has a circular outer peripheral shape may be adopted.

According to the configuration, since the rotary journal section also serves as the binding member of the heat transfer tubes, the number of components of the heat transfer tube unit does not increase. For this reason, the configuration of the multiple tube-type heat exchanger can be kept simple.

By making the outer peripheral shape of the rotary journal section circular, the rotation support section provided outside the heat exchanger shell can be made into a simple roller type. The heat transfer tube unit can be immediately rotated about the central axis simply by placing the rotary journal section on the roller.

In the multiple tribe-type heat exchanger having the configuration, a configuration where the rotary journal section also serves as a pipe fixing plate, that is sandwiched between a body of the heat exchanger shell and a water chamber-forming lid and determines positions of the heat transfer tubes in the longitudinal axis direction may be adopted.

In the configuration, since the rotary journal section serves as the binding member of the heat transfer tubes and the pipe fixing plate of the heat transfer tubes, the structure of the heat transfer tube unit can be prevented from being complicated.

In the multiple tube-type heat exchanger having the configuration, at least one of the rotary journal sections may have a columnar shape extending along the central axis.

In the configuration, since the shape of the rotary journal section can be miniaturized and simplified, an increase in costs caused by providing the rotary journal section can be suppressed to the minimum, and the rotary journal section in the multiple tube-type heat exchanger can be prevented from inhibiting the exchange of heat.

According to a second aspect of the invention, there is provided a heat transfer tube Gleaning method, for a multiple tube-type heat exchanger having a cylindrical heat exchanger shell and a heat transfer tube unit accommodated inside the heat exchanger shell. The method includes a taking-out step of taking out the heat transfer tube unit from the inside of the heat exchanger shell, a pivotally supporting step of enabling a predetermined rotation support section provided outside the heat exchanger shell to pivotally support a plurality of rotary journal sections provided at points located at a distance from each other in a longitudinal axis direction of the heat transfer tube unit, a cleaning step of removing a sticky scale adhered to a heat transfer tube of the heat transfer tube unit while rotating the heat transfer tube unit, and a mounting step of mounting the heat transfer tube unit, for which the cleaning is completed, inside the heat exchanger shell.

In the heat transfer tube cleaning method for a multiple tube-type heat exchanger, the heat transfer tube unit can be rotated about the central axis when the rotary journal sections of the heat transfer tube unit taken out from the inside of the heat exchanger shell are pivotally supported by the predetermined rotation support section provided outside the heat exchanger shell. Consequently, the heat transfer tube unit can be efficiently cleaned by high-pressure water injection, thereby enabling the multiple tube-type heat exchanger to be operated with high energy efficiency.

Advantageous Effects of Invention

In the multiple tube-type heat exchanger and the heat transfer tube cleaning method for the same according to the invention, the heat transfer tube unit accommodated inside the heat exchanger shell is efficiently cleaned, the removing rate of the sticky scale covering the surfaces of the heat transfer tubes is improved, and a performance as a heat exchanger is sufficiently demonstrated. Thus, it is possible to operate with high energy efficiency.

DESCRIPTION OF EMBODIMENTS

Hereinafter, embodiments of the invention will be described with reference to the drawings.

First Embodiment

Figure 1:
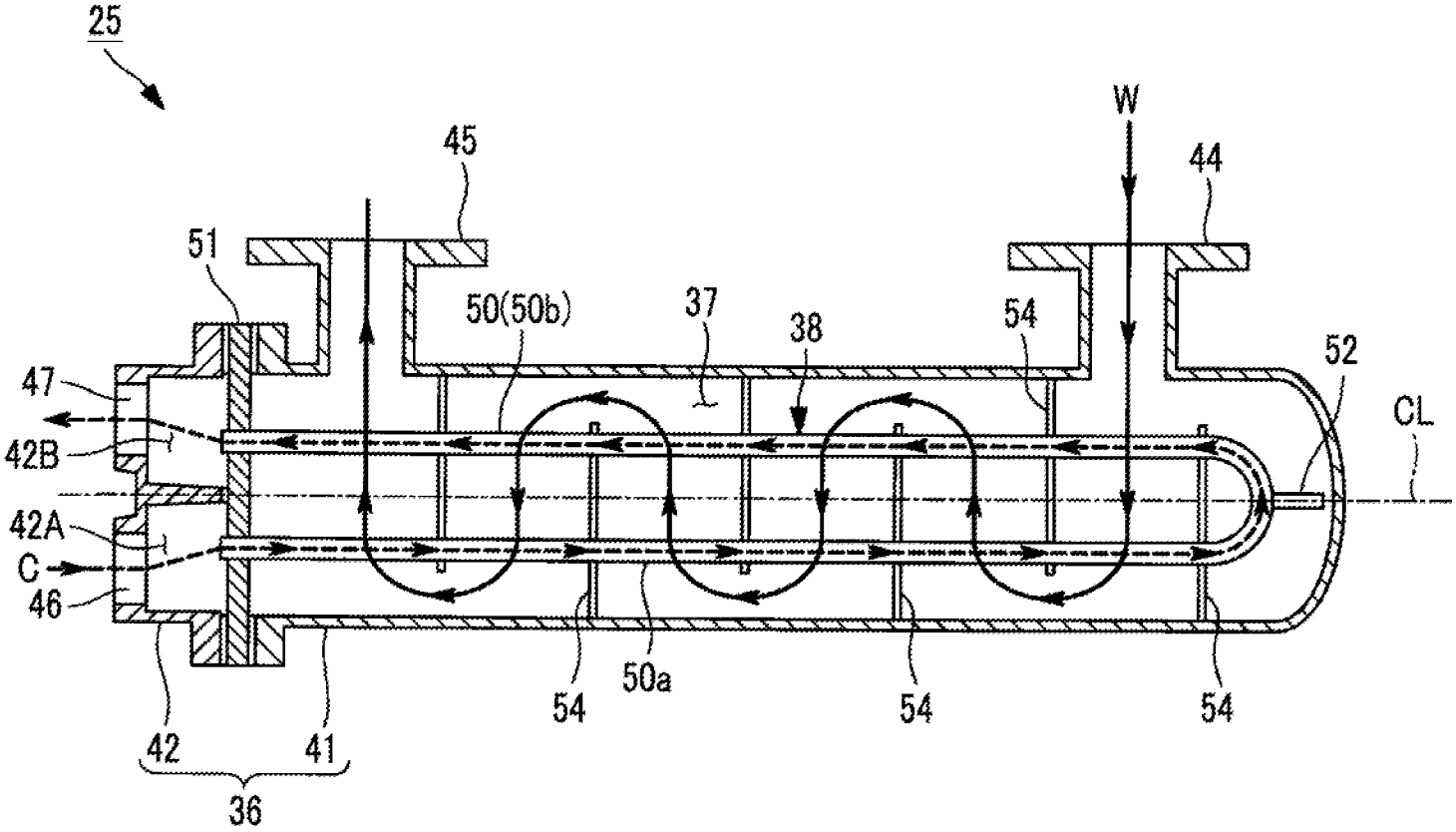
FIG. 1 is a longitudinal sectional view of one example of a structure of a multiple tube-type heat exchanger.
Figure 2:
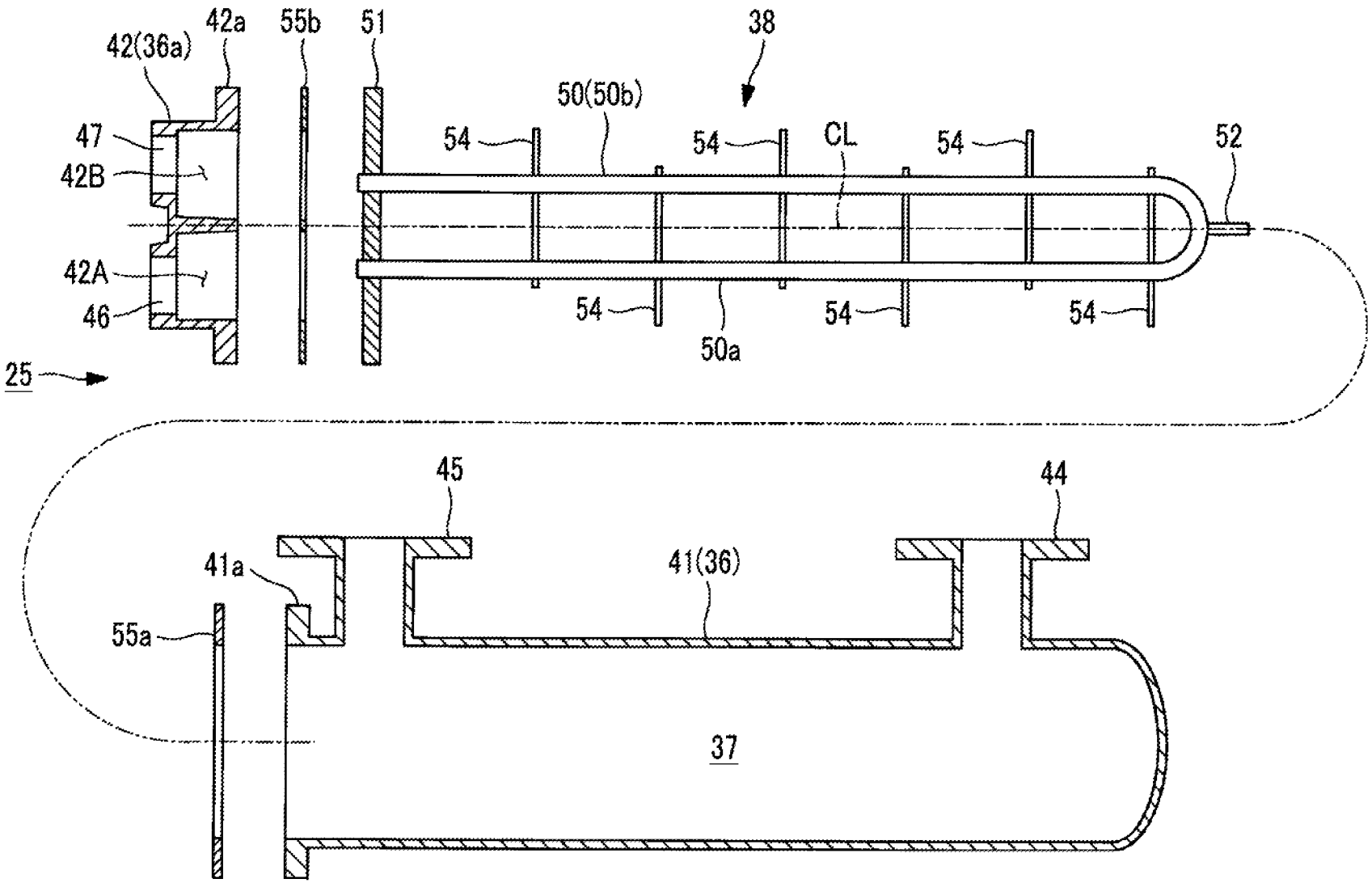
FIG. 2 is an exploded view of the multiple tube-type heat exchanger illustrated in FIG. 1, and is a view illustrating a first embodiment of the invention.

FIG. 1 is a longitudinal sectional view illustrating a first embodiment of a slag water cooler 25 (multiple tube-type heat exchanger), and FIG. 2 is an exploded view of the slag water cooler 25 illustrated in FIG. 1. The slag water cooler 25 is applied, for example, to the cooling of water (slag water W) in a slag discharging system, which transports slag from a coal gasifier, by exchanging heat with cooling water, but is not limited to this application.

The slag water cooler 25 is a so-called shell and tube type, and is configured such that a heat transfer tube unit 38 is mounted in a removable manner in a shell chamber 37 inside a horizontally mounted cylindrical heat exchanger shell 36. The heat exchanger shell 36 includes a cylindrical body 41, of which one end is open, and the other end is closed, and a water chamber-forming lid 42 which is liquid-tightly fixed to an opening of the body 41 in a removable manner.

A slag water inlet 44 through which the slag water W, that is, a process liquid to be cooled in the embodiment, flows into the shell chamber 37 and a slag water outlet 45 through which the slag water W flows out from the shell chamber 37 are provided in a peripheral surface of the body 41 so as to be located at a distance from each other in a longitudinal axis direction. A pipe connected to a discharge port of a circulation pump (not illustrated) is connected to the slag water inlet 44, and a pipe connected to a slag hopper of a petroleum gasifier (not illustrated) is connected to the slag water outlet 45.

The inside of the water chamber-forming lid 42 is vertically bisected. For example, an inlet chamber 42A is provided on the lower side, and an outlet chamber 42B is provided on the upper side. A cooling water inlet 46 and a cooling water outlet 47 are provided in the chambers 42A and 42B respectively. A pipe, through which cooling water C that is a temperature control solution is supplied from a cooling water supply system (not illustrated), is connected to the cooling water inlet 46, and a pipe, through which the cooling water C heated after exchanging heat with the high-temperature slag water W inside the shell chamber 37 returns to the cooling water supply system, is connected to the cooling water outlet 47.

The heat transfer tube unit 38 is configured to include, for example, a plurality of U-shaped heat-transfer tubes 50 extending in the longitudinal axis direction of the shell chamber 37 inside the heat exchanger shell 36 (body 41), a rotary journal section 51, which is a binding member that binds the plurality of heat transfer tubes 50, a short columnar rotary journal section 52 that is provided on end portions on a U-curved side of the heat transfer tubes 50 and extends along a central axis CL, which are concentric with the rotary journal section 51, and a plurality of baffle plates 54.

The two rotary journal sections 51 and 52 are concentric with the central axis CL of the heat transfer tube unit 38, and are provided at positions of one end and the other end of the heat transfer tube unit 38 in a direction of the central axis CL so as to be located at a distance from each other. The central axis CL is a baseline passing through a central portion of the entire heat transfer tube unit 38 in a longitudinal direction, preferably, a line-symmetric line (for example, a line passing through the centroid) in terms of the weight of the entire heat transfer tube unit 38. The plurality of baffle plates 54 are arranged, for example, in a zigzag with respect to the U-shaped heat transfer tubes 50. The shapes of the heat transfer tubes 50 are not limited to a U-shape, and may be a straight line or another curve shape. In addition, the shapes or positions of the baffle plates 54 are not limited thereto.

Figure 3:
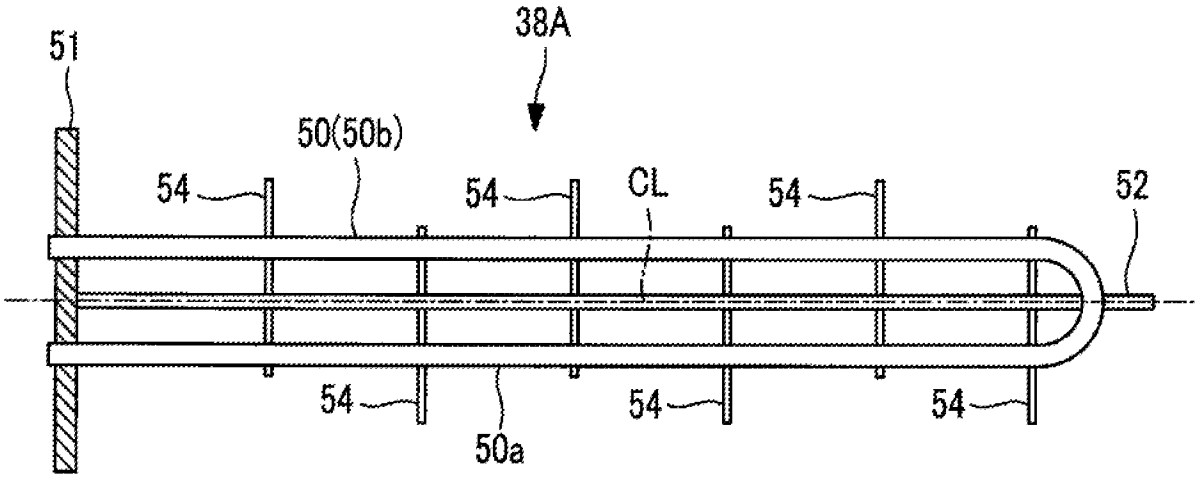
FIG. 3 is a side view of a heat transfer tube unit according to a modification example of the first embodiment.

For example, as in a heat transfer tube unit 38A illustrated in FIG. 3 as a modification example, the rotary journal section 52 may be configured such, that the rotary journal section extends from the back surface of the rotary journal section 51, extends rearwards along the central axis CL of the heat transfer tube unit 38, penetrates through the plurality of baffle plates 54, and protrudes slightly from U-shaped portions of the plurality of heat transfer tubes 50 as the rotary journal section 52 illustrated in FIG. 1 and FIG. 2.

By doing so, a load applied to an end of a bundle of the heat transfer tubes 50 can be distributed and held by the entire heat transfer tubes 50 via the rotary journal sections 51 and 52 and the plurality of baffle plates 54 penetrating through the rotary journal section 52, and thus the occurrence of deformation of the end portion of the rotary journal section 52 can be reduced. In addition, it is not necessary to change the strength structure of the end portion of the bundle of the heat transfer tubes.

Figure 4:
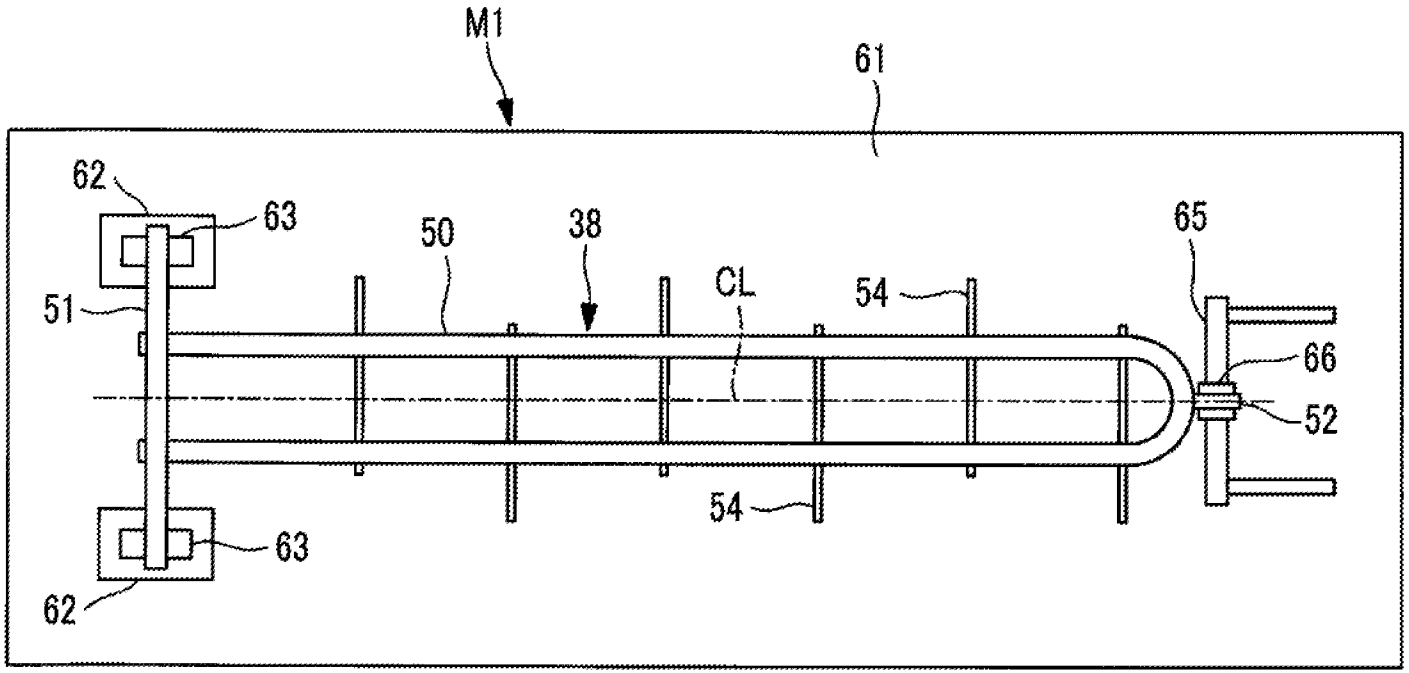
FIG. 4 is a plan view illustrating a state where a heat transfer tube unit according to the first embodiment is mounted on a maintenance frame.
Figure 5:
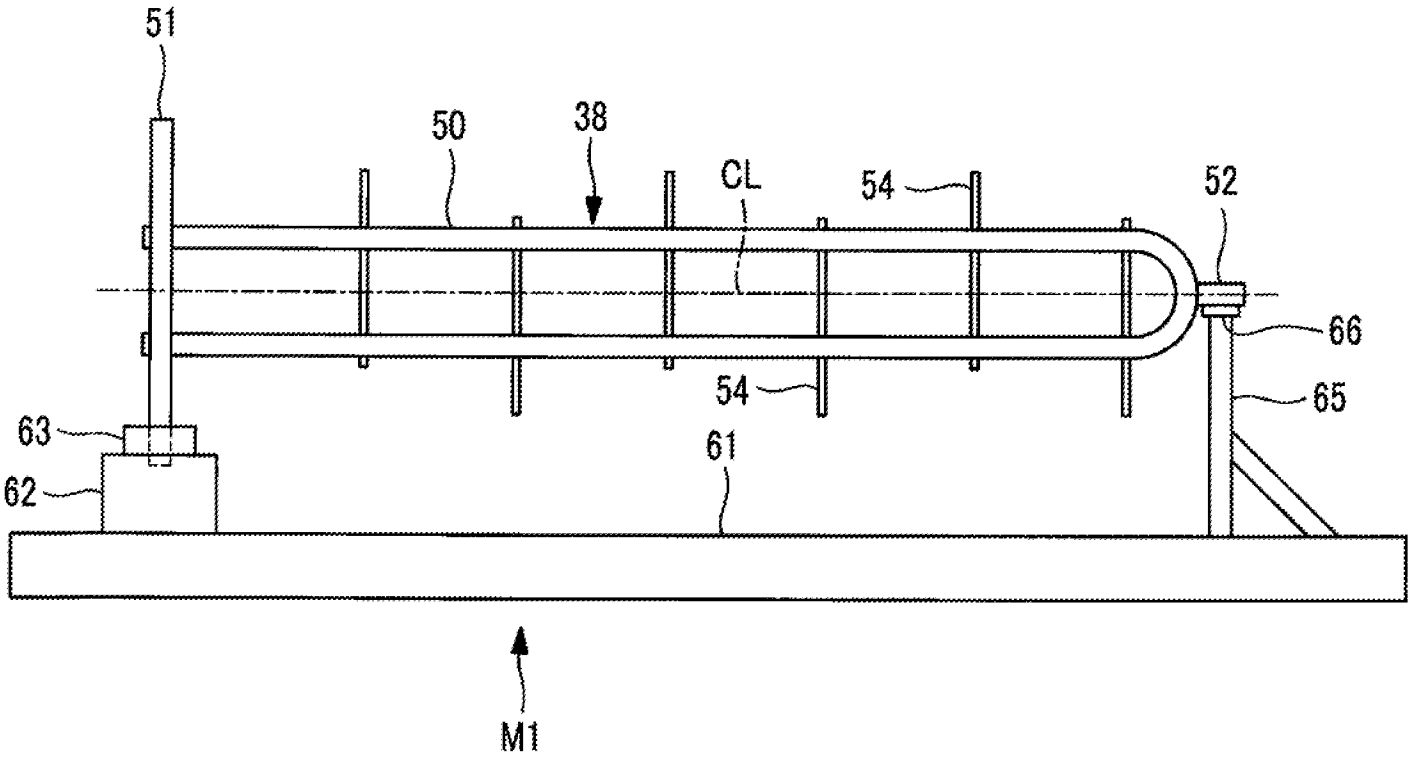
FIG. 5 is the same side view.

In the embodiment, the rotary journal section 51 has, for example, a disk shape, and also serves as a binding member that binds the plurality of heat transfer tubes 50. That is, although it seems that only one U-shaped heat transfer tube 50 is provided in FIG. 1 and FIG. 2, the plurality of heat transfer tubes 50 are arranged in a direction orthogonal to the drawing so as to overlap each other, and the plurality of heat transfer tubes 50 penetrate through the rotary journal section 51 and are fixed, to the rotary journal section 51 by welding. Therefore, the respective heat transfer tubes 50 are adjacent to each other at minute, intervals. The rotary journal sections 51 and 52 enable the heat transfer tube unit 38 provided outside the heat exchanger shell 36 to be supported by a predetermined rotation support section (maintenance frame M1 illustrated in FIG. 4 and FIG. 5), as will be described later.

As illustrated in FIG. 2, a fastening flange 41*a* is formed on the opening of the body 41, the rotary journal section 51 is sandwiched between the fastening flange 41*a* and a fastening flange 42*a* formed on the water chamber-forming lid 42 via annular gaskets 55*a* and 55*b*. The fastening flanges 41*a* and 42*a*, the rotary journal section 51, the gaskets 55*a* and 55*b* are integrally fastened by multiple bolts (not illustrated) and nuts (not illustrated). Therefore, the position of each of the heat transfer tubes 50 in the longitudinal axis direction is determined. That is, the rotary journal section 51 is the binding member that binds the plurality of heat transfer tubes 50 as described above, and is also be a pipe fixing plate that determines the positions of the heat transfer tubes 50 in the longitudinal axis direction.

The heat transfer tubes 50 each includes an outgoing passage 50*a* and an incoming passage 50*b*. In an assembled state of the slag water cooler 25 (refer to FIG. 1), the outgoing passages 50*a* communicate with the cooling water inlet 46, and the incoming passages 50*b* communicate with the cooling water outlet 47. As illustrated in FIG. 1, the cooling water C flows in the cooling water inlet 46, the inlet chamber 42A, the outgoing passages 50*a* of the heat transfer tubes 50, the incoming passages 50*b*, the outlet chamber 42B, and the cooling water outlet 47 in this order.

The slag water W flows from the slag water inlet 44 into the shell chamber 37, flows in the shell chamber 37 while alternately circumventing the plurality of baffle plates 54 provided in a zigzag from near the U-shaped end portions of the heat transfer tubes 50 toward the rotary journal section 51, sufficiently comes into contact with each of the heat transfer tubes 50, and is cooled by exchanging heat with the cooling water C. After then, the slag water flows out from the slag water outlet 45.

The slag water W passes through the shell chamber 37 of the slag water cooler 25 configured as described above. The slag water W is water, from which most slag is removed by a slag separation device (not illustrated), but is not completely filtered water. Therefore, the slag water is a suspension mixed with a small amount of slag particles. For this reason, over the long-term operation, the slag particles included in the slag water W gradually adhere to and deposit on surfaces of the heat transfer tubes 50 of the heat transfer tube unit 38 in the shell chamber 37 of the slag water cooler 25, thereby becoming a sticky scale. Therefore, the heat transferring performance of the heat transfer tubes 50 decreases.

Figure 9:
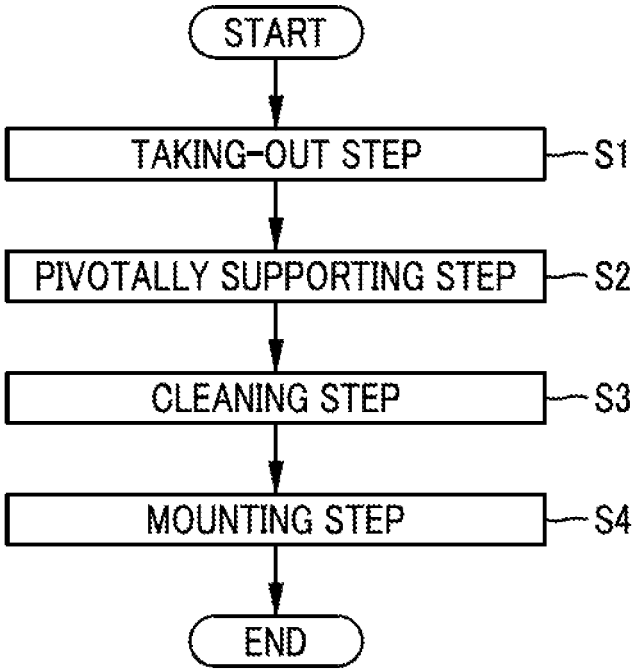
FIG. 9 is a flow chart showing flow of a heat transfer tube cleaning method for a multiple tube-type heat exchanger according to the invention.

Each time a predetermined operating time elapses, the heat transfer tube unit 38 is taken out from the inside of the heat exchanger shell 36 of the slag water cooler 25 to be cleaned. A cleaning method of the heat transfer tube unit 38 will be described with reference to FIG. 2 to FIG. 5 and a flow chart of FIG. 9.

(1) Taking-Out Step

First, the heat transfer tube unit 38 is taken out from the inside of the heat exchanger shell 36 (taking-out step S1). At this time, at least a portion near the rotary journal section 51 of the heat transfer tube unit 38 is lifted with the use of a crane or a chain block to pull out the heat transfer tube unit 38 from the body 41.

(2) Pivotally Supporting Step

Next, the predetermined maintenance frame M1 (rotation support section) provided outside the slag water cooler 25 pivotally supports each of the two rotary journal sections 51 and 52 provided so as to be located at a distance from each other in the longitudinal axis direction of the heat transfer tube unit 38 (pivotally supporting step S2). The maintenance frame M1 may be mounted in advance in the vicinity of the heat transfer tube unit 38, or may be mounted only at the time of cleaning.

The maintenance frame M1 has, for example, a flat mounting stand 61. On one end portion of an upper surface of the maintenance frame, supporting rollers 63 are pivotally supported via a pair of right and left roller supporting blocks 62. On the pair of right and left supporting rollers 63, the disk-shaped rotary journal section 51 provided at one end of the heat transfer tube unit 38 is placed. As described above, since the rotary journal section 51 is placed on the supporting rollers 63, it is preferable that outer peripheral portions thereof be smooth.

In addition, for example, a strut 65 is erected on an upper rear portion of the mounting stand 61, and a half-split sliding bearing 66 is provided on an upper end portion of the strut. The rotary journal section 52 provided at the other end of the heat transfer tube unit 38 is placed on the bearing 66. Therefore, in a state where the heat transfer tube unit 38 is placed on the maintenance frame M1, the heat transfer tube unit can freely rotate about the central axis CL.

(3) Cleaning Step

Next, the heat transfer tube unit 38 is cleaned, for example, by a high-pressure water injector or a brush while the heat transfer tube unit 38 is being rotated (cleaning step S3). The heat transfer tube unit 38 rotates about the central axis CL. By setting the central axis CL to a line-symmetric line (line passing through the centroid) in terms of the weight of the entire heat transfer tube unit 38, an operator can easily rotate the heat transfer tube unit 38 with one hand and usability becomes better. While the entire heat, transfer tube unit 38 is being rotated in this manner, high-pressure water is thoroughly injected, and thus the sticky scale adhered to the surfaces of the heat transfer tubes 50 is peeled off and cleaned.

(4) Mounting Step

Lastly, the cleaned heat transfer tube unit 38 is again mounted inside the heat exchanger shell 36 (mounting step S4), and cleaning operation is completed.

As described above, in the slag water cooler 25 and a cleaning method for the same according to the embodiment, the following effects are achieved.

That is, in a state where the heat transfer tube unit 38 taken out from the inside of the heat exchanger shell 36 is placed on (pivotally supported by) the maintenance frame M1, the heat transfer tube unit 38 can be cleaned, for example, by the high-pressure water injector while the heat transfer tube unit 38 is being rotated. For this reason, the entire heat transfer tube unit 38 can be thoroughly cleaned. In particular, the sticky scale adhered to the heat transfer tubes 50 positioned deep in the heat transfer tube unit 38, which has been difficult to remove, can also be peeled off and cleaned.

At this time, by rotating the heat transfer tube unit 38, high-pressure water can be injected from any position. Consequently, high-pressure water can foe injected from a mounting surface (ground level) of the maintenance frame M1. For this reason, preliminary operation such as temporarily providing a scaffold as in the related art is not necessary. Therefore, the heat transfer tubes 50 can be efficiently cleaned, thereby enabling a multiple tube-type heat exchanger such as the slag water cooler 25 to be operated with high energy efficiency.

Since the cleaning of the heat transfer tube unit 38 means removing only the heat transfer tube unit 38 from the heat exchanger shell 36 with the heat exchanger shell 36 configuring the slag water cooler 25 being fixed in the field, it is not necessary to remove piping of the slag water W and cooling water connected to the heat exchanger shell 36. Consequently, it is not necessary for pipe connection portions of the slag water cooler 25 to be provided with a special seal structure, and a rise in costs and a decrease in reliability can foe avoided by keeping the structure simple.

The rotary journal section 51 of the heat transfer tube unit 38 also serves as the binding member that puts the heat transfer tubes 50 together. The plurality of heat transfer tubes 50 penetrate through and are fixed to the rotary journal section. The outer peripheral shape of the rotary journal section is circular. As described above, since the rotary journal section 51 also serves as the binding member of the heat transfer tubes 50, the number of components of the heat transfer tube unit 38 does not increase. For this reason, the configuration of the slag water cooler 25 can be kept simple.

By making the outer peripheral shape of the rotary journal section 51 circular, the maintenance frame M1 provided outside the heat exchanger shell 36 can be made into a simple roller type, and the heat transfer tube unit 38 can be easily rotated about the central axis CL.

The rotary journal section 51 also serves as the pipe fixing plate that is sandwiched between the body 41 and the water chamber-forming lid 42 of the heat exchanger shell 36 and determines the positions of the heat transfer tubes 50 in the longitudinal axis direction. For this reason, the rotary journal section 51 serves as the binding member of the heat transfer tubes 50 and the pipe fixing plate of the heat transfer tubes 50, and accordingly the structure of the heat transfer tube unit 38 can be prevented from being complicated.

Since the rotary journal section 52 has a columnar shape extending along the central axis CL of the heat transfer tube unit 38, the shape of the rotary journal section 52 can be miniaturized and simplified. Consequently, an increase in costs caused by providing the rotary journal section 52 can be suppressed to the minimum, and the rotary journal section 52 in the slag water cooler 25 can be prevented from inhibiting the exchange of heat. Although the rotary journal section 52 is supported from below in the embodiment, the rotary journal section 52 may be supported such that the rotary journal section hangs from above.

Second Embodiment

Next, a second embodiment of the invention will be described with reference to FIG. 6 to FIG. 8. A heat transfer tube unit 38B illustrated herein is different from the heat transfer tube unit 38 of the first embodiment in that a rotary journal section 70 having the same disk shape as that of the rotary journal section 51 is provided instead of the columnar rotary journal section 52 in the heat transfer tube unit 38 of the first embodiment. Other portions are the same. Consequently, the same configuration units will be assigned with the same reference signs and description thereof will be omitted.

Figure 6:
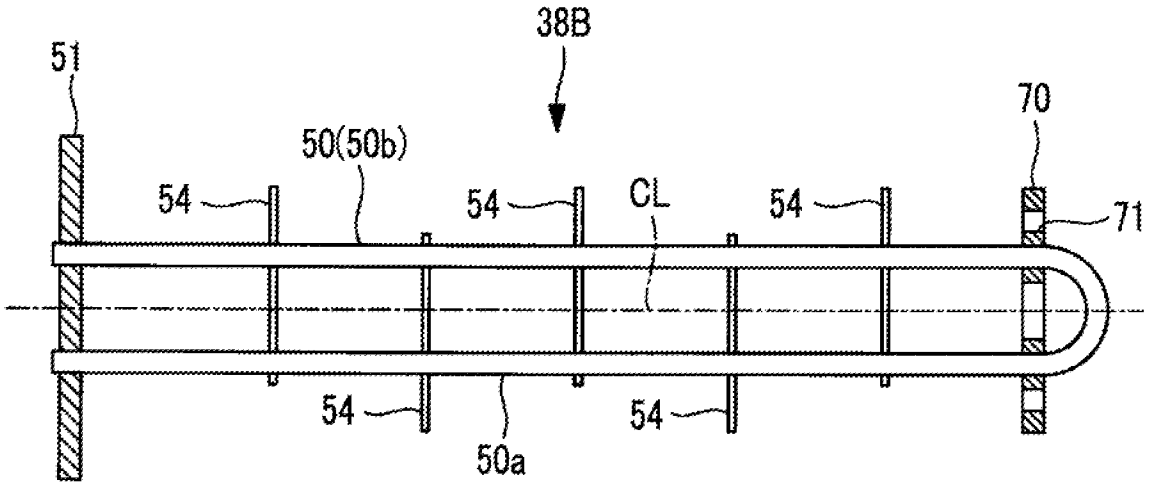
FIG. 6 is a side view of a heat transfer tube unit according to a second embodiment of the invention.

As illustrated in FIG. 6, the rotary journal section 70 is also a binding member that penetrates through the plurality of heat transfer tubes 50 to put the heat transfer tubes together just as the rotary journal section 51, is in a circular plate shape, and an outer peripheral portion thereof is smooth. An outer diameter thereof is set to a length that allows itself to be smoothly inserted into the heat exchanger shell 36 (body 41) illustrated in FIG. 2. That is, the outer diameter is smaller than the diameter of the rotary journal section 51. A plurality of liquid circulation holes 71 are pierced in the rotary journal section 70, and do not disturb the circulation of the slag water W inside the heat exchanger shell 36 (shell chamber 37).

Figure 7:
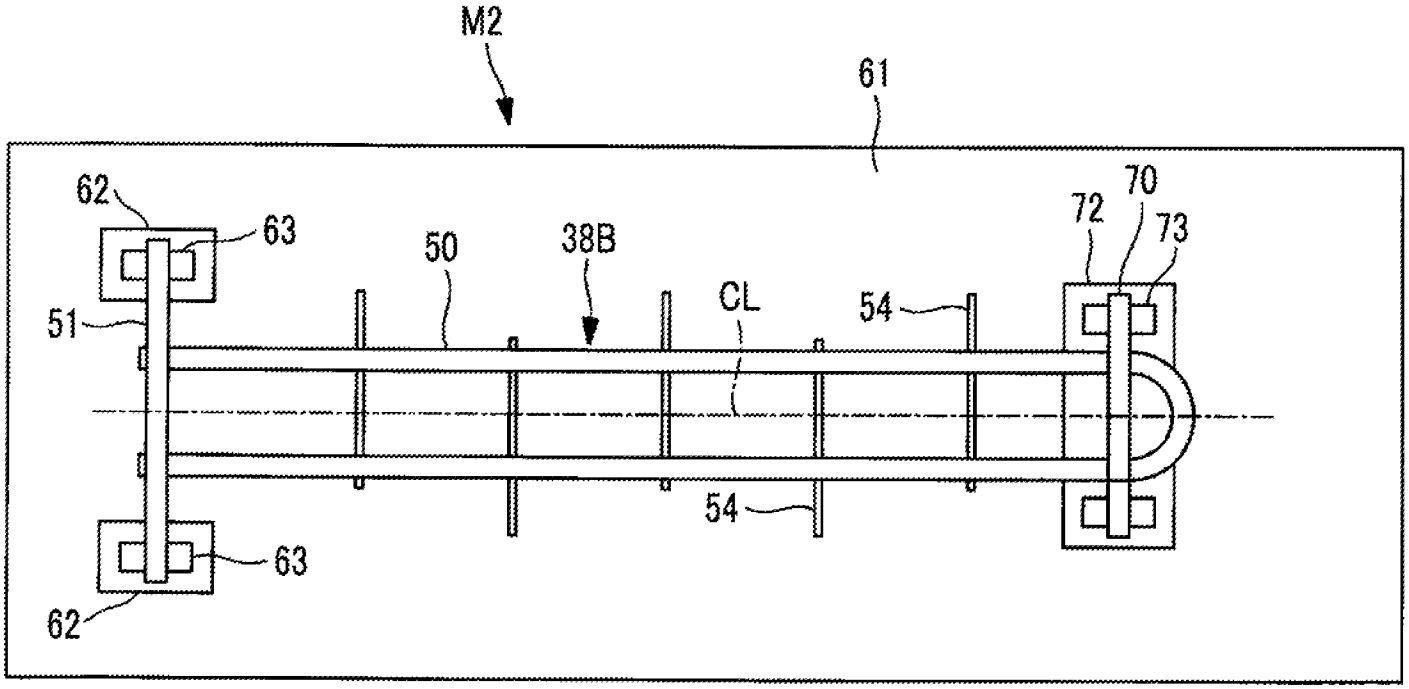
FIG. 7 is a plan view illustrating a state where the heat transfer tube unit according to the second embodiment is mounted on the maintenance frame.
Figure 8:
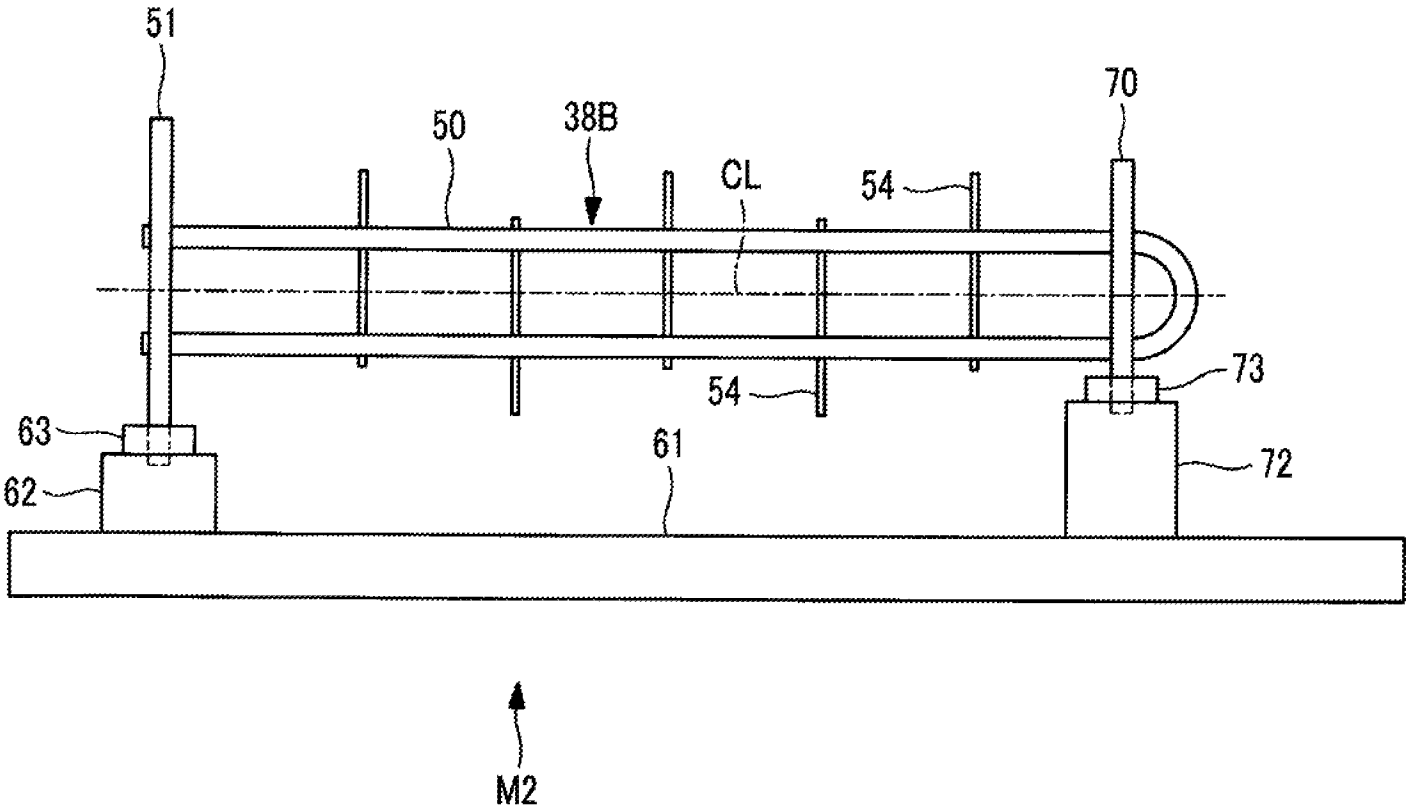
FIG. 8 is the same side view.

A maintenance frame M2 that supports and rotates the heat transfer tube unit 38B when cleaning the heat transfer tube unit has a structure of supporting the rotary journal section 70 of the heat transfer tube unit 38B, which is different from the structure of the maintenance frame M1 of the first embodiment, as illustrated in FIG. 7 and FIG. 8. Specifically, the maintenance frame includes a roller supporting block 72 and supporting rollers 73 that are the same as the roller supporting blocks 62 and the supporting rollers 63, which support the rotary journal section 51. That is, both ends of the heat transfer tube unit 38B in a longitudinal axis direction thereof are supported by the supporting rollers 63 and 73 and the heat transfer tube unit can freely rotate.

As described above, by having the rotary journal section 70, which is on a rear portion of the heat transfer tube unit 38B, in the same disk shape as the rotary journal section 51, the maintenance frame M2 is made into a simple roller type. By simply placing the rotary journal sections 51 and 70 on the rollers 63 and 73, the heat transfer tube unit 38B can be immediately rotated about the central axis CL. For this reason, cleaning operation can be performed more efficiently.

According to the slag water cooler 25 (multiple tube-type heat exchanger) and the heat transfer tube cleaning method for the same according to the embodiment, the heat transfer tube unit accommodated inside the heat exchanger shell is efficiently cleaned, the removing rate of the sticky scale covering the surfaces of the heat transfer tubes is improved, and a performance as a heat exchanger is sufficiently demonstrated. Thus, it is possible to operate with high energy efficiency.

The invention is not limited to the configurations of the embodiments, and an appropriate modification or improvement can be made thereto. An embodiment to which such a modification or improvement is made also fails in the scope of the invention.

An example in which the invention is applied to the slag water cooler 25 included in the slag discharging system of a petroleum gasification plant is described in the embodiments. Without being limited thereto, however, the invention can also be applied to multiple tube-type heat exchangers of a wide range of other technical fields.

REFERENCE SIGNS LIST 25 slag water cooler (multiple tube-type heat-exchanger)
36 heat exchanger shell
38, 38A, 38B heat transfer tube unit
41 body
42 water chamber-forming lid
50 heat transfer tube
51 rotary journal section (binding member, pipe fixing plate)
52, 70 rotary journal section
CL central axis
M1, M2 maintenance frame (rotation support section)
S1 taking-out step
52 pivotally supporting step
53 cleaning step
54 mounting step

The invention claimed is:

1. A multiple tube-type heat exchanger comprising:
a cylindrical heat exchanger shell; and
a heat transfer tube unit that is mounted in a removable manner inside the heat exchanger shell,
wherein the heat transfer tube unit includes
a plurality of heat transfer tubes extending inside the heat exchanger shell in a longitudinal axis direction,
a binding member that binds the heat transfer tubes, and
a plurality of rotary journal sections that are concentric with a central axis of the heat transfer tube unit, are provided at positions located at a distance from each other in a direction of the central axis, and enable the heat transfer tube unit to be supported by a predetermined rotation support section provided outside the heat exchanger shell,
wherein at least one of the rotary journal sections also serves as the binding member, allows the plurality of heat transfer tubes to penetrate therethrough and to be fixed thereto, and has a circular outer peripheral shape, and
at least one of the rotary journal sections has a coluiimar shape extending along the central axis.

2. The multiple tube-type heat exchanger according to claim 1,
wherein the rotary journal section also serves as a pipe fixing plate that is sandwiched between a body of the heat exchanger shell and a water chamber-forming lid and determines positions of the heat transfer tubes in the longitudinal axis direction.

3. A heat transfer tube cleaning method for, a multiple tube-type heat exchanger including a cylindrical heat exchanger shell, a heat transfer tube unit that is accommodated inside the heat exchanger shell and is configured by a plurality of beat transfer tubes bound by a binding member, and a plurality of rotary journal sections provided at points located at a distance from each other in a longitudinal axis direction of the heat transfer tube unit, and in which at least one of the rotary journal sections also serves as the binding member, allows the plurality of heat transfer tubes to penetrate therethrough and to be fixed thereto, and has a circular outer peripheral shape, and at least one of the rotary journal sections has a columnar shape extending along the central axis, the method comprising:

a taking-out step of taking out the heat transfer tube unit from the inside of the heat exchanger shell;

a pivotally supporting step of enabling a predetermined rotation support section provided outside the heat exchanger shell to pivotally support the rotary journal sections;

a cleaning step of cleaning the heat transfer tubes of the heat transfer tube unit to which a sticky scale is adhered while rotating the heat transfer tube unit; and a mounting step of mounting the heat transfer tube unit, for which the cleaning is completed, inside the heat exchanger shell.

* * * * *